United States Patent [19]

Casazza, Jr.

[11] Patent Number: 4,773,159

[45] Date of Patent: Sep. 27, 1988

[54] CLIP-ON FOLDING KNIFE

[76] Inventor: Joseph J. Casazza, Jr., 502 Red Hill Rd., Middletown, N.J. 07748

[21] Appl. No.: 84,487

[22] Filed: Aug. 12, 1987

[51] Int. Cl.[4] ..... B26B 1/02; B26B 1/10

[52] U.S. Cl. ..... 30/155; 30/296 A; 224/269

[58] Field of Search ..... 30/151, 153, 155, 157, 30/296 A, 296 R, 340; 7/168; 224/232, 252, 269

[56] References Cited

U.S. PATENT DOCUMENTS

| | | | |
|---|---|---|---|
| 1,803,899 | 5/1931 | Fuller | 30/297 A X |
| 1,913,142 | 6/1933 | Ondricek | 224/269 X |
| 2,468,959 | 5/1949 | Cannon | 7/168 X |
| 2,586,740 | 2/1952 | Swanson | 224/252 |
| 2,839,831 | 6/1958 | Baer | 30/296 A |

*Primary Examiner*—Frank T. Yost
*Assistant Examiner*—Michael D. Folkerts
*Attorney, Agent, or Firm*—Charles I. Brodsky

[57] ABSTRACT

A folding knife incorporating a pair of recesses inwardly of its oppositely facing handles, to receive a resilient clip assembly enabling the knife to be secured to one's belt or pockets for easy, left-hand or right-hand carrying about.

8 Claims, 1 Drawing Sheet

CLIP-ON FOLDING KNIFE

The present invention has been described under a filing with the Disclosure Document Program on Oct. 2, 1986, under File Designation 156733.

FIELD OF THE INVENTION

The present invention relates to the field of folding knives, in general, and to such knives as may easily be carried about, secured to a person's belt or pockets, for ready use.

BACKGROUND OF THE INVENTION

As will be readily apparent to those skilled in the art, folding knives come of many varieties—as for field use, hunting, fishing, boating, or just utility, in general—and in many shapes and sizes. As is also apparent, it is desirable to carry these folding-knives about in an easy, uncomplicated manner—rather than to merely carry them about in one's pockets. Although arrangements have been described in the prior art for "clipping" a folding knife to one's belt or pocket, some of such known arrangements clip onto the handle, so as to change the feel and heft of the knife when being held—as well as changing the aesthetic appearance of the knife, itself. For the true sportsman who uses the knife for field use, hunting, or fishing, for example, such modifications are clearly unacceptable—as also follows from the fact that these knives are intended either for right-hand or left-hand use; a right-handed clip-on knife, as an illustration, has a clip that permits securement to the right-side of a wearer's belt, with the "clip portion" fitting between the belt and the wearer himself, with the handle exposed and with the blade operable to be folded forwardly—but, if intended to be worn by a left-handed person, such clipping to the left side of the wear's belt with the handle exposed would cause the blade to open rearwardly, which is not the preferred condition for an avid sportsmen. Thus, purchasers of clip-on folding knives that are generally available must specify their desire for a right-handed, or left-handed, knife, as the case may be—and, oftentimes face the possibility that the knife style they desire is not available in that left-handed or right-handed design, only the other configuration.

SUMMARY OF THE INVENTION

As will become clear hereinafter, the folding knife of the present invention is adaptable for clip-on use in eithr a left-hand or right-hand manner. As will also be seen, the knife includes a resilient clip assembly which is secured on the inwardly facing sides of the handle, so as not to be exposed in changing the overall appearance for the knife, itself. As will also be appreciated, by securing the assembly generally symmetrically on either side of the handle, the heft of the knife remains unchanged, the balance of the knife is retained, and its usage—either by left-handed or right-handed persons—remains unchanged. As will also become clear, a resilient clip assembly is secured in a recess design, according to the invention, in a manner so as to prevent lateral, side-to-side movement so as to reduce any possible blade movement as the knife is actuated forwardly in use. Such feature will be appreciated to be of significant concern in various manners of using a knife—as, for example, in a scraping action. And, as will be seen, for all intents and purposes, a lay person viewing the knife will detect no visible difference between its appearance, when constructed according to the invention, and that of an ordinary pocket-knife, or folding knife, not intended for a clip-on connection to one's belt, trousers, jacket or shirt pocket, swimsuit, shorts, etc.

BRIEF DESCRIPTION OF THE DRAWING

These and other features of the invention will be more clearly understood from a consideration of the following description, taken in connection with the drawing, in which.

DETAILED DESCRIPTION OF THE DRAWING

Figure 1:
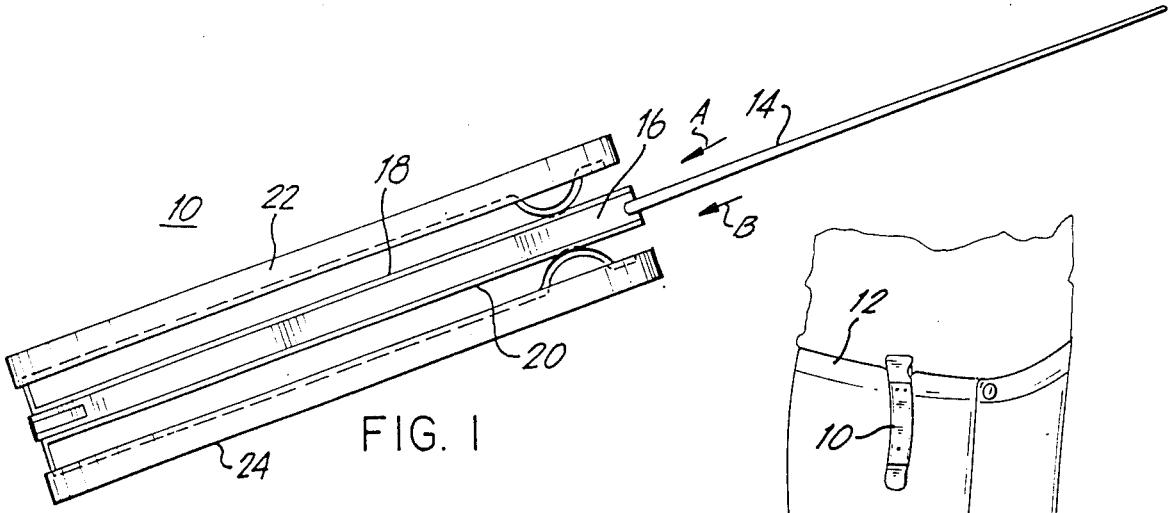
FIG. 1 shows the folding knife of the invention as it would appear with its blade opened.

Referring to the drawing, the knife of the invention 10, adapted to be secured, for example, to a user's belt 12, incorporates a blade 14 extending from a central housing 16 (i.e., a knife case) having opposing sides 18, 20. The folding knife 10 also incorporates a pair of oppositely facing handles 22, 24, within which are provided a pair of recesses extending along the underside of the handle 22, 24 along its length, and, in accordance with the present invention, are shown as being generally rectangular in configuration. As illustrated more particularly in FIG. 2, the knife 10 is also provided with a pair of resilient clip assemblies 30, 32, having an elongated base section 34 with a slotted-opening 36 adjacent to the end 38 from whence the blade 14 extends, when the knife is being used. As is also shown more clearly in FIG. 2, the resilient clip assemblies 30, 32 also incorporates a pair of spring-like extensions 40, 42, arranged generally parallel to the base sections 34 (with which it forms a single, integral structure), having a "hump" 44 of dimension to substantially fit within and occupy the slotted-opening 36 when the blade is opened and extending outwardly of the knife (FIG. 1). As will be more clearly seen from the bottom two sections of the composite of FIG. 2, the spring-like extensions are configured to fit within the handle recesses (either 26, or 28) and in close alignment, where they are secured together as by means of rivet connections (as via openings 46, 48, FIG. 2) or by any type of adhesive securement, where desired. As will also be noted from FIG. 2, the base sections 34 of the clip assemblies 30, 32 are arranged to be likewise secured to the opposite sides 18, 20 of the housing 16—again by means of rivet connections (through the openings 50, 52) or by appropriate adhesion. In accordance with the invention, furthermore, the end 54 of the clip assemblies 30, 32 is arranged to conform, generally, to the shape of the end 38 of the housing 16—which, in turn, is arranged to generally correspond to the ends 56, 58 of the oppositely facing handles 22, 24. In a preferred embodiment of the invention, furthermore, the "hump" 44, and the spring-like extensions 40, 42, are provided with a resiliency so as to release outwardly of the slotted-opening 36 upon the feeding of a fabric, or similar, material towards the "hump" 44, from the direction of the end 54. Additionally, the resiliency afforded to the extensions 40, 42 is of such a nature, as to attempt to return the "hump" 44 inwardly of the slotted-openings 36 once the fabric, or other, material has been received in place, thereby holding the clip assemblies 30, 32 secure to the material. In effectuating this, the clip assemblies 30, 32 are each manufactured of a metallic composition, of sufficient rigidity to attempt to retain its original configuration of the "hump" 44 extending inwardly and through the slotted-openings 36.

Figure 3:
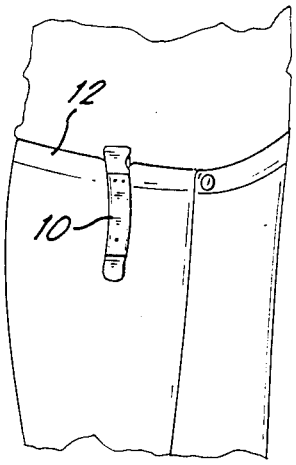
FIG. 3 illustrates one knife design incorporating the invention as would be clipped to a user's belt for carrying about.
Figure 2:
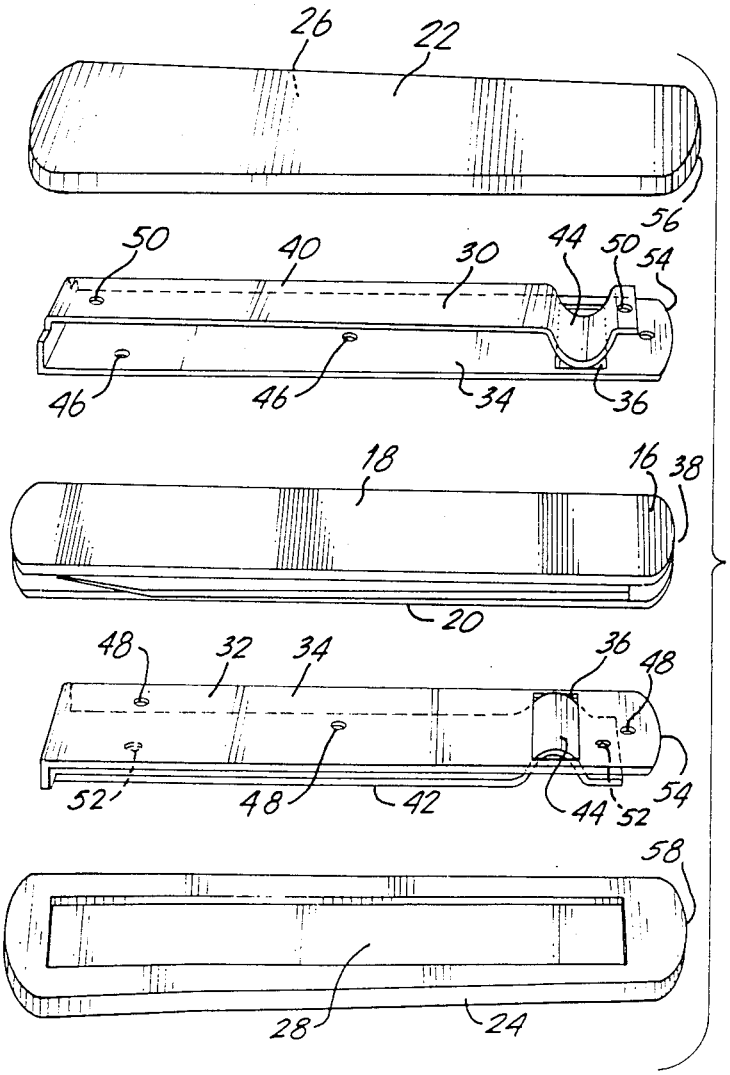
FIG. 2 is a composite showing how the folding knife of the invention is to be assembled.

With the composite sections of FIG. 2 in place, it will be appreciated that the knife of the invention will take-on the shape shown in FIG. 1 (albeit with the blade 14 closed). Because of the resiliency afforded by the hump and clip assembly, it then becomes a simple matter to attach the closed knife to a belt, trousers, or any available pocket, simply by feeding the material inwardly of the directions A, or B of FIG. 1, to be secured in place by the resiliency of the assemblies 30, or 32. By virtue of the symmetrical arrangement, it will become apparent that such securement can be either through the direction of A or B, enabling the knife to be secured on either side, left-or-right, and in a manner to have the blade arranged to open forwardly, as is the desired manner of use by those regularly employing knives in their occupation or sporting activities. As will be readily apparent, the particular knife embodying the invention can employ any particular shape (note the difference in the configurations between the knives of FIGS. 1 and 2 and that of FIG. 3), and to a casual observer, the knife simply appears as an ordinary folding knife, without any clip attachments. As will similarly be appreciated, the symmetrical arrangement enables the knife to continue to afford the same balance and heft, as without a clip attachment—and, with such an attachment is not exposed to make the ornamentation of the constructed knife any different from its original, aesthetic design. When desired for use, the knife is simply clasped and drawn outwardly from its securement, in which event the spring-like extensions 40, 42 are actuated to direct the "hump" 44 outwardly of its holding, slotted-opening 36, and the knife is then ready in position, arranged to be openable with the blade forward. When, once again, it is desired to be secured in place, all that is required is for the constructed knife to be pushed down, once more, over the belt, fabric, or other material where it is to be retained, awaiting later, subsequent use.

And, as will be seen, by configuring the end 54 of the clip assemblies 30, 32 to conform in shape with the corresponding end of the recesses 26, 28, the blade will be generally held in place as the knife is moved in use, thereby limiting any tendency for a side-to-side movement as the blade is being used.

With the invention as thus far described, it will be apparent that its usage can follow for both left-handed and right-handed participants, without the need for purchasing different units depending upon the left-handedness or right-handedness of the ultimate user, and that the holding clip assemblies 30, 32, are not exposed so as to invite damage through bumping, or falling. The aesthetic design is maintained, the comfortableness of the handle grip maintained, and without any tendency for slippage due to the unexposed surface area of the clips—all leading to a continued safety in use, and with the arrangement, once secured, being ready for quick availability merely by a simple removal action.

While there have been described what are considered to be preferred embodiments of the present invention, it will be readily appreciated by those skilled in the art that modifications can be made without departing from the scope of the teachings herein. For at least such reason, therefore, resort should be had to the claims appended hereto for a correct understanding of the scope of the invention.

I claim:

1. A folding knife comprising:

a housing defined by a pair of side surfaces and including a knife blade foldable internally between said surfaces;

a pair of opposingly facing handles of predetermined length, each handle having a first surface defining the outwardly facing contour of said knife, and each handle also having an inwardly facing second surface including a recess extending along the length thereof;

first means secured to one of said side housing surfaces and aligned to seat within one of said inwardly facing second surface recesses in securement of said first means to one of said pair of handles;

second means secured to the other of said side housing surfaces and aligned to seat within the other of said inwardly facing second surface recesses in securement of said second means to the other of said pair of handles;

and wherein said first means incorporates a first resilient means biased towards said one side housing surface yet displaceable towards said one inwardly facing second surface recess in response to a translational force imparted thereto;

and wherein said second means incorporates a second resilient means biased towards said other side housing surface yet displaceable towards said other inwardly facing second surface recess in response to a translational force inparted thereto;

and wherein the bias provided each of said first and second resilient means towards said one and said other side housing surfaces, respectively, is of a magnitude sufficient to secure any structural material producing translational forces upon said resilient means when inserted between either of said first and second resilient means and said pair of housing side surfaces.

2. The folding knife of claim 1 wherein said first and second means are adhesively secured to said side housing surfaces.

3. The folding knife of claim 1 wherein said first and second means are mechanically secured to said side housing surfaces.

4. The folding knife of claim 1 wherein said first and second means are additionally adhesively secured to said handle recesses.

5. The folding knife of claim 1 wherein said first and second means are additionally mechanically secured to said handle recesses.

6. The folding knife of claim 3 wherein said first and second means are additionally mechanically secured to said handle means.

7. The folding knife of claim 1 wherein at least one of said first and second means also incorporates a notch adjacent to its said respective resilient means and wherein said notch is dimensioned to receive said resilient means upon displacement thereof in the presence of imparted translational forces.

8. The folding knife of claim 7 wherein said notch is incorporated in both of said first and second means.

* * * * *